US011747747B2

(12) United States Patent
Shimizu et al.

(10) Patent No.: US 11,747,747 B2
(45) Date of Patent: Sep. 5, 2023

(54) IMAGE FORMING APPARATUS AND CONTROL METHOD OF IMAGE FORMING APPARATUS

(71) Applicant: KYOCERA Document Solutions Inc., Osaka (JP)

(72) Inventors: Tamotsu Shimizu, Osaka (JP); Yoshihiro Yamagishi, Osaka (JP); Kazunori Tanaka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/901,706

(22) Filed: Sep. 1, 2022

(65) Prior Publication Data

US 2023/0075031 A1 Mar. 9, 2023

(30) Foreign Application Priority Data

Sep. 6, 2021 (JP) ..... 2021-144467

(51) Int. Cl.
*G03G 15/06* (2006.01)

(52) U.S. Cl.
CPC ..... *G03G 15/065* (2013.01)

(58) Field of Classification Search
CPC ..... G03G 15/065
USPC ..... 399/53, 55
See application file for complete search history.

(56) References Cited

U.S. PATENT DOCUMENTS 11,112,722 B1 * 9/2021 Shimizu ..... G03G 15/55

FOREIGN PATENT DOCUMENTS

JP 2003295540 A 10/2003

* cited by examiner

*Primary Examiner* — Hoan H Tran
(74) *Attorney, Agent, or Firm* — Alleman Hall Creasman & Tuttle LLP

(57) ABSTRACT

An image forming portion applies a bias voltage in which an AC component is superimposed on a DC component between a first carrying member and a second carrying member, and transfers toner from the first carrying member to the second carrying member to form an image on the second carrying member. An AC setting processing portion performs AC calibration to set a magnitude of the AC component of the bias voltage. A potential measurement processing portion measures a surface potential of the first carrying member or the second carrying member based on a target current flowing between the first carrying member and the second carrying member. A drive processing portion executes the AC calibration before measurement of the surface potential in a case where, when measuring the surface potential, an activation condition is satisfied.

9 Claims, 9 Drawing Sheets

IMAGE FORMING APPARATUS AND CONTROL METHOD OF IMAGE FORMING APPARATUS

INCORPORATION BY REFERENCE

This application is based upon and claims the benefit of priority from the corresponding Japanese Patent Application No. 2021-144467 filed on Sep. 6, 2021, the entire contents of which are incorporated herein by reference.

The present disclosure relates to an image forming apparatus and a control method of the image forming apparatus.

BACKGROUND

As related art, a technique is known in which, in an image forming apparatus, a surface potential on a photoconductor is found and used as feedback to control charging of the photoconductor. That is, in an electrophotographic type image forming apparatus (electrophotographic apparatus), a charged photoconductor is exposed based on image data, and an electrostatic latent image is formed on the photoconductor. The image forming apparatus applies a bias voltage to a developing roller, and by supplying charged toner to the photoconductor according to an electric field between the developing roller and photoconductor, causes the toner to adhere to an exposed portion on the photoconductor, and forms an image by developing the electrostatic latent image on the photoconductor.

In this type of image forming apparatus, fluctuations in the surface potential (charging potential) of the photoconductor affect the image quality, and thus in the image forming apparatus according to the related art, the surface potential of the photoconductor is found, and charging of the photoconductor is controlled so that a constant surface potential is obtained. Here, the image forming apparatus according to the related art forms a pulse-shaped electrostatic potential pattern on the photoconductor, detects a current corresponding to a switching point of the electrostatic potential pattern, and finds the surface potential on the photoconductor based on the current.

SUMMARY

An image forming apparatus according to one aspect of the present disclosure includes an image forming portion, an AC setting processing portion, a potential measurement processing portion, and a drive processing portion. The image forming portion applies a bias voltage in which an AC component is superimposed on a DC component between a first carrying member and a second carrying member, and transfers toner from the first carrying member to the second carrying member to form an image on the second carrying member. The AC setting processing portion performs AC calibration to set a magnitude of the AC component of the bias voltage. The potential measurement processing portion measures a surface potential of the first carrying member or the second carrying member based on a target current flowing between the first carrying member and the second carrying member. The drive processing portion executes the AC calibration before measurement of the surface potential in a case where, when measuring the surface potential, an activation condition is satisfied.

A control method of an image forming apparatus according to another aspect of the present disclosure is used for an image forming apparatus including an image forming portion configured to apply a bias voltage in which an AC component is superimposed on a DC component between a first carrying member and a second carrying member, and to transfer toner from the first carrying member to the second carrying member to form an image on the second carrying member. The control method of the image forming apparatus includes: performing an AC calibration to set a magnitude of the AC component of the bias voltage; measuring a surface potential of the first carrying member or the second carrying member based on a target current flowing between the first carrying member and the second carrying member; and executing the AC calibration before measurement of the surface potential in a case where, when measuring the surface potential, an activation condition is satisfied.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Embodiments according to the present disclosure will be described below with reference to the accompanying drawings. Note that the following embodiments are examples of implementing techniques according to the present disclosure and do not limit the technical scope of the present disclosure.

First Embodiment

[1] Overall Configuration of Image Forming Apparatus

First, the overall configuration of an image forming apparatus 10 according to the present embodiment will be described with reference to FIG. 1 and FIG. 2.

For convenience of explanation, in an installed state (state shown in FIG. 2) in which it is possible to use the image forming apparatus 10, a vertical direction is defined as vertical direction D1. In addition, a front-rear direction D2 is defined with the surface on the left side of the paper surface of the image forming apparatus 10 shown in FIG. 2 as the front surface (front surface). Further, a left-right direction D3 is defined with the front surface of the image forming apparatus 10 in the installed state as a reference.

As an example of the image forming apparatus 10 of this embodiment is a multifunction peripheral having a plurality of functions such as a scanning function for reading image data from a document sheet, a printing function for forming an image based on image data, a facsimile function, and a copying function. The image forming apparatus 10 may have a function of forming an image, and may be a printer, a facsimile apparatus, a copying machine, or the like.

Figure 1:
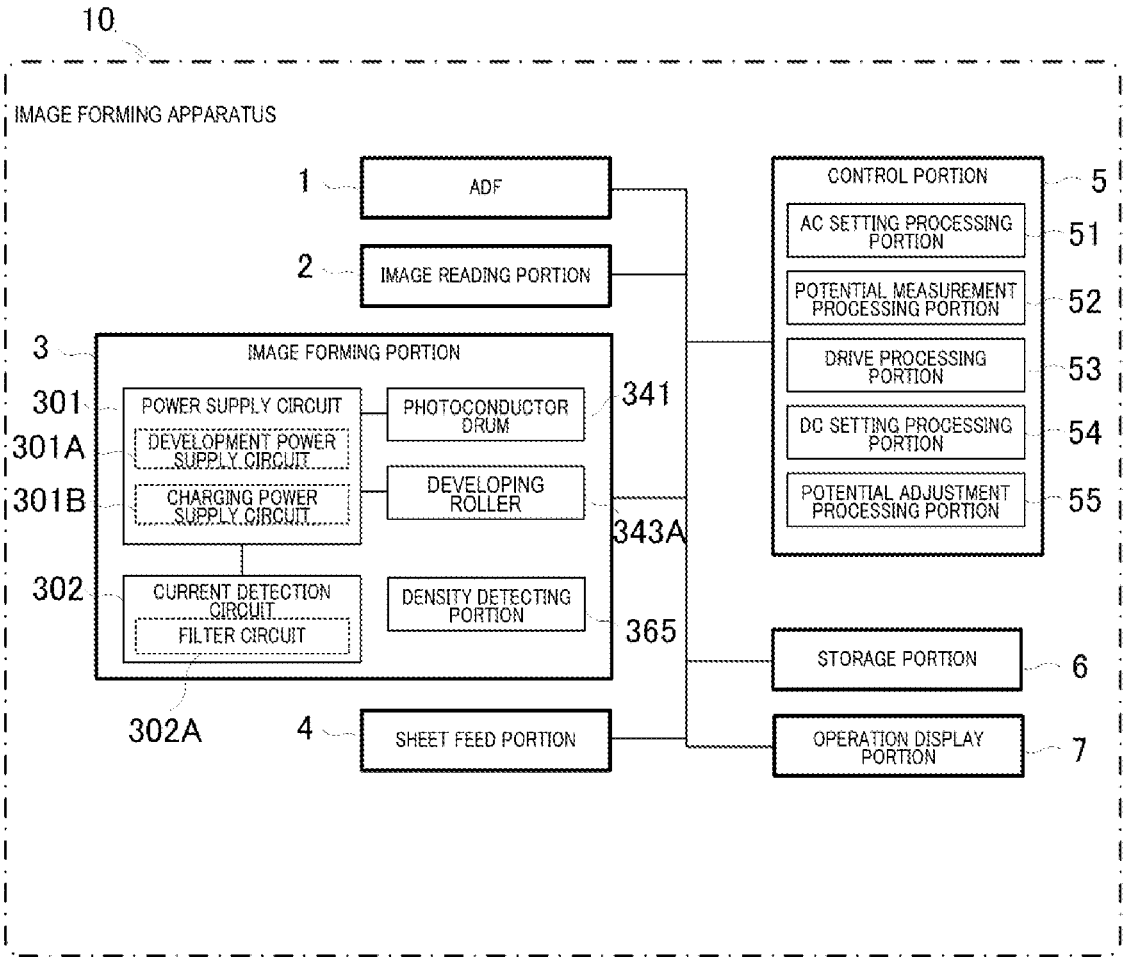
FIG. 1 is a block diagram showing a configuration of an image forming apparatus according to a first embodiment.

As shown in FIG. 1, the image forming apparatus 10 includes an auto document sheet conveying device 1, an image reading portion 2, an image forming portion 3, a sheet feed portion 4, a control portion 5, a storage portion 6 and an operation display portion 7. The auto document sheet conveying device 1 is an auto document feeder (ADF), and thus is notated as "ADF" in FIG. 1, and is also referred to as "ADF 1" in the following description.

The ADF 1 conveys a document sheet whose image is to be read by the image reading portion 2. The ADF 1 includes a document setting portion, a plurality of conveying rollers, a document sheet holder, a paper discharge portion, and the like.

The image reading portion 2 reads an image from a document sheet and outputs image data corresponding to the read image. The image reading portion 2 has a document sheet table, a light source, a plurality of mirrors, an optical lens, a charge coupled device (CCD) and the like.

The image forming portion 3 achieves a printing function by forming a color or monochrome image on a sheet by electrophotography. The image forming portion 3 forms an image on a sheet based on image data that is outputted from the image reading portion 2. In addition, the image forming portion 3 forms an image on a sheet based on image data that is inputted from an information processing apparatus such as a personal computer or the like that is outside of the image forming apparatus 10.

The sheet feed portion 4 supplies a sheet to the image forming portion 3. The sheet feed portion 4 has a sheet feed cassette, a manual feed tray, a sheet conveying path, a plurality of conveying rollers, and the like. The image forming portion 3 forms an image on a sheet that is supplied from the sheet feed portion 4.

The control portion 5 performs overall control of the image forming apparatus 10. The control portion 5 is mainly configured by a computer system having one or more processors and one or more memories. In the image forming apparatus 10, the function of the control portion 5 is achieved by one or more processors executing a program. The program may be recorded in advance in memory (storage portion 6), may be provided via a telecommunication line such as the Internet, or may be recorded and provided on a non-transitory recording medium such as a memory card or optical disc that is readable by a computer system. The one or more processors are configured by one or more electronic circuits including semiconductor integrated circuits. Further, the computer system referred to here includes a microcontroller having one or more processors and one or more memories. The control portion 5 may also be a control portion separately provided from a main control portion that performs overall control of the image forming apparatus 10.

The storage portion 6 includes one or more non-volatile memories and stores in advance information such as a control program for causing the control portion 5 to execute various types of processing. Further, the storage portion 6 is used as a temporary memory (work area) for various types of processing executed by the control portion 5.

The operation display portion 7 is a user interface in the image forming apparatus 10. The operation display portion 7 has a display portion such as a liquid crystal display that displays various types of information according to a control instruction from the control portion 5, and an operation portion such as switches or a touch panel for inputting various types of information to the control portion 5 according to user operation.

[2] Configuration of Image Forming Portion

Next, the configuration of the image forming portion 3 will be described in detail with reference to FIG. 1 to FIG. 4.

Figure 2:
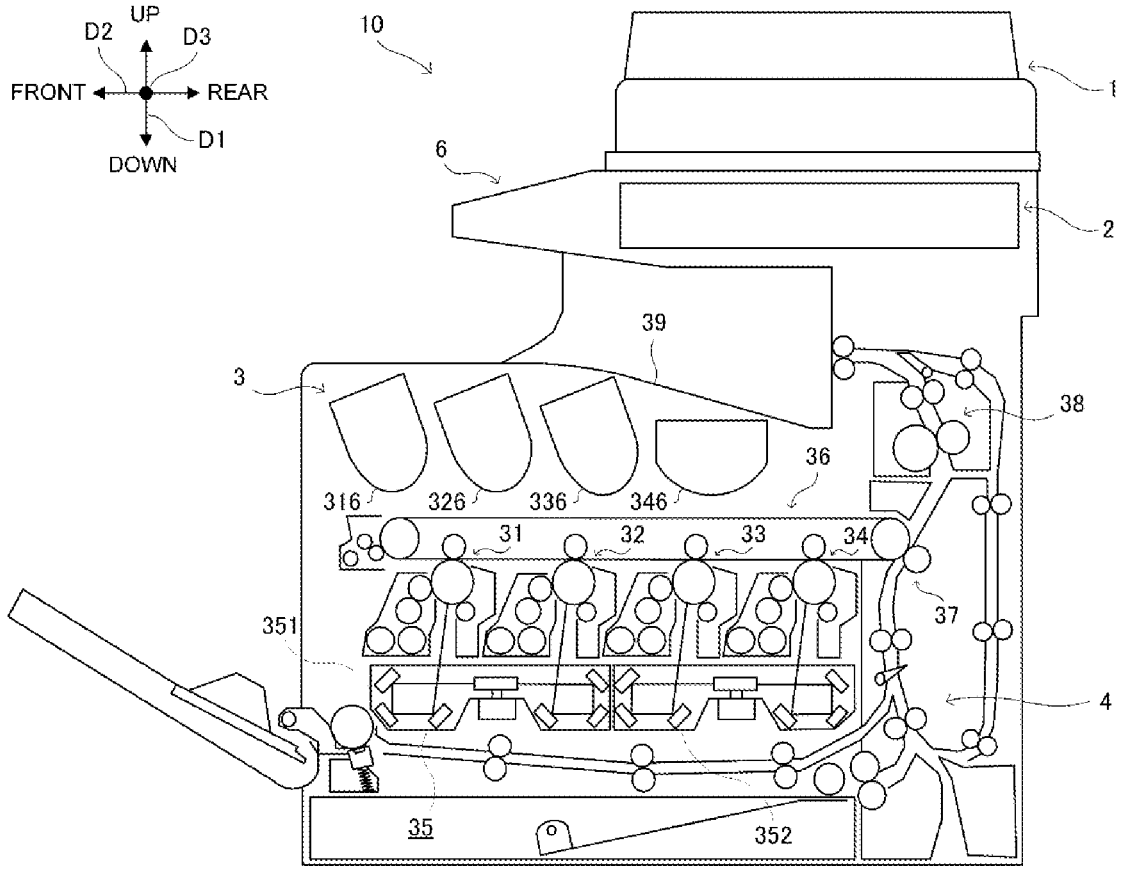
FIG. 2 is a schematic diagram showing a configuration of an image forming apparatus according to a first embodiment.
Figure 3:
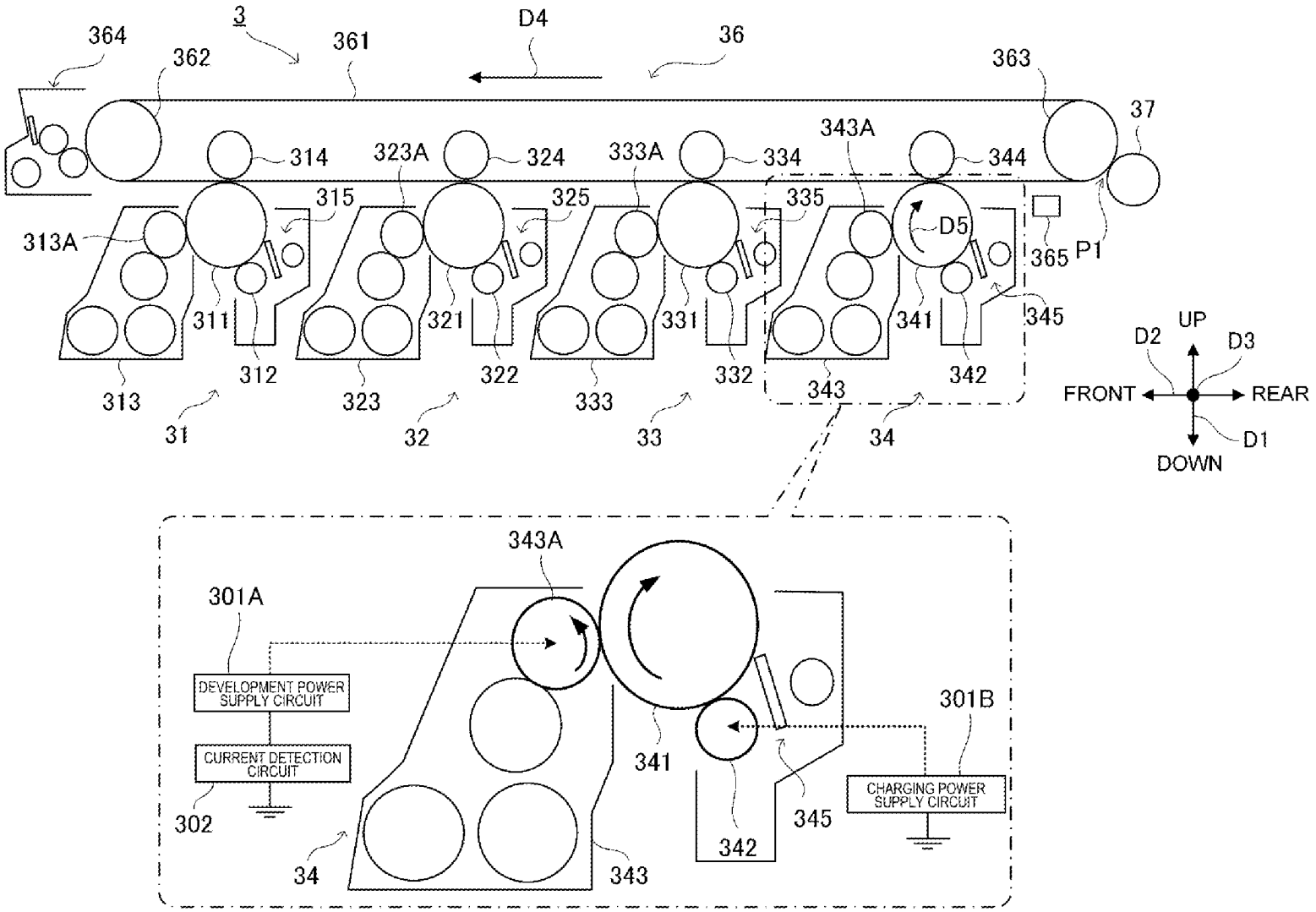
FIG. 3 is a schematic diagram showing a configuration of an image forming portion of an image forming apparatus according to a first embodiment.

As shown in FIG. 2, the image forming portion 3 has four image forming units 31 to 34, laser scanning unit 35, an intermediate transfer device 36, a secondary transfer roller 37, a fixing device 38, and a sheet discharge tray 39. Inside the balloon in FIG. 3 is an enlarged view schematically showing a configuration of one image forming unit 34 of the four image forming units 31 to 34.

The image forming unit 31 forms a Y (yellow) toner image. As shown in FIG. 3, the image forming unit 31 has a photoconductor drum 311, a charging roller 312, a developing device 313 including a developing roller 313A, a primary transfer roller 314, and a drum cleaning portion 315. In addition, the image forming unit 31 further has a toner container 316 (see FIG. 2).

The image forming unit 32 forms a C (cyan) toner image. As shown in FIG. 3, the image forming unit 32 has a photoconductor drum 321, a charging roller 322, a developing device 323 including a developing roller 323A, a primary transfer roller 324, and a drum cleaning portion 325. In addition, the image forming unit 32 further has a toner container 326 (see FIG. 2).

The image forming unit 33 forms an M (magenta) toner image. As shown in FIG. 3, the image forming unit 33 has a photoconductor drum 331, a charging roller 332, a developing device 333 including a developing roller 333A, a primary transfer roller 334, and a drum cleaning portion 335. In addition, the image forming unit 33 further has a toner container 336 (see FIG. 2).

The image forming unit 34 forms a K (black) toner image. As shown in FIG. 3, the image forming unit 34 has a photoconductor drum 341, a charging roller 342, a developing device 343 including a developing roller 343A, a primary transfer roller 344, and a drum cleaning portion 345. In addition, the image forming unit 34 further has a toner container 346 (see FIG. 2).

Moreover, as shown in FIG. 1, each of the plurality of image forming units 31 to 34, in addition to the configuration described above, further has a power supply circuit 301 and a current detection circuit 302. That is, a power supply circuit 301 and a current detection circuit 302 are provided in each of the plurality of image forming units 31 to 34. Each power supply circuit 301 includes a development power supply circuit 301A and a charging power supply circuit 301B.

In this way, the plurality (four in this case) of image forming units 31 to 34 correspond to four colors of Y (yellow), C (cyan), M (magenta), and K (black), respectively, and basically a common configuration is adopted. Therefore, in the following description, unless specified otherwise, the configuration described for the image forming unit 34 has the same configuration as the other image forming units 31 to 33. Even in the balloons of FIGS. 1 and 3, the photoconductor drum 341, the developing roller 343A, the power supply circuit 301, the current detection circuit 302, and the like are only shown for the image forming unit 34.

An electrostatic latent image is formed on the photoconductor drum 341. The photoconductor drum 341 is rotatably supported around a rotation axis extending in the left-right direction D3 by a unit housing that houses the photoconductor drum 341, the charging roller 342, and the drum cleaning portion 345. The photoconductor drum 341, receives a driving force supplied from a motor, for example, and rotates in a rotation direction D5 shown in FIG. 3.

The charging roller 342 charges the surface (outer peripheral surface) of the photoconductor drum 341 positively. More specifically, the charging roller 342 is electrically connected to the charging power supply circuit 301B of the power supply circuit 301, and by receiving a high voltage (high voltage) applied from the charging power supply circuit 301B, charges the surface of the photoconductor drum 341. However, the charging roller 342 is not limited to the configuration in which the surface of the photoconductor drum 341 is charged positively, and may be charged negatively.

The surface of the photoconductor drum 341 charged by the charging roller 342 is irradiated with light based on the image data from the laser scanning unit 35. Thus, an electrostatic latent image is formed on the surface of the photoconductor drum 341. That is, the portion of the surface of the photoconductor drum 341 irradiated with the light from the laser scanning unit 35 becomes an "image portion".

The developing device 343 executes a developing process for developing the electrostatic latent image formed on the surface of the photoconductor drum 341. Particularly, in this embodiment, the developing device 343 performs development using a two-component developer including a toner and a carrier. For example, the developing device 343 includes a case, a pair of stirring members, a magnet roller, a developing roller 343A, and the like. The case rotatably supports the pair of stirring members, the magnet roller, and the developing roller 343A about a rotation axis extending in the left-right direction D3. In addition, the case houses the K (black) toner and carrier. The pair of stirring members stir the toner and the carrier housed in the case to charge the toner. In the present embodiment, the toner is positively charged. However, the charging polarity of the toner is not limited to being positive, and may be negative. The magnet roller pumps up the toner and carrier that have been stirred by the pair of stirring members, and of these supplies the toner to the surface (outer peripheral surface) of the developing roller 343A.

The developing roller 343A uses the charged toner to develop an electrostatic latent image formed on the photoconductor drum 341. More specifically, the developing roller 343A is electrically connected to the development power supply circuit 301A of the power supply circuit 301, and by receiving a developing bias VB (see FIG. 4) applied from the development power supply circuit 301A, supplies toner to the surface of the photoconductor drum 341. That is, by a high-voltage developing bias VB being applied in the development power supply circuit 301A between the developing roller 343A and the photoconductor drum 341, a developing electric field is formed and toner having an electric charge is transferred from the developing roller 343A to the photoconductor drum 341. Thus, a toner image corresponding to the electrostatic latent image is formed on the surface of the photoconductor drum 341.

In the present embodiment, the developing roller 343A is an example of a "first carrying member", and the photoconductor drum 341 is an example of a "second carrying member". That is, the image forming portion 3, by the developing electric field, moves the toner having an electric charge from the developing roller 343A, which is the first carrying member, to the photoconductor drum 341, which is the second carrying member, and forms a toner image (image) corresponding to the electrostatic latent image on the photoconductor drum 341 (second carrying member). In other words, in the development process, the image forming portion 3 moves the toner having an electric charge from the first carrying member to the second carrying member to form an image on the second carrying member. Here, the photoconductor drum 341, which is the second carrying member, rotates in the rotation direction D5, and thus the portion of the surface of the photoconductor drum 341 facing the developing roller 343A changes with the passage of time. In other words, the portion of the surface of the photoconductor drum 341 facing the developing roller 343A moves in the rotation direction D5 of the photoconductor drum 341.

Figure 4:
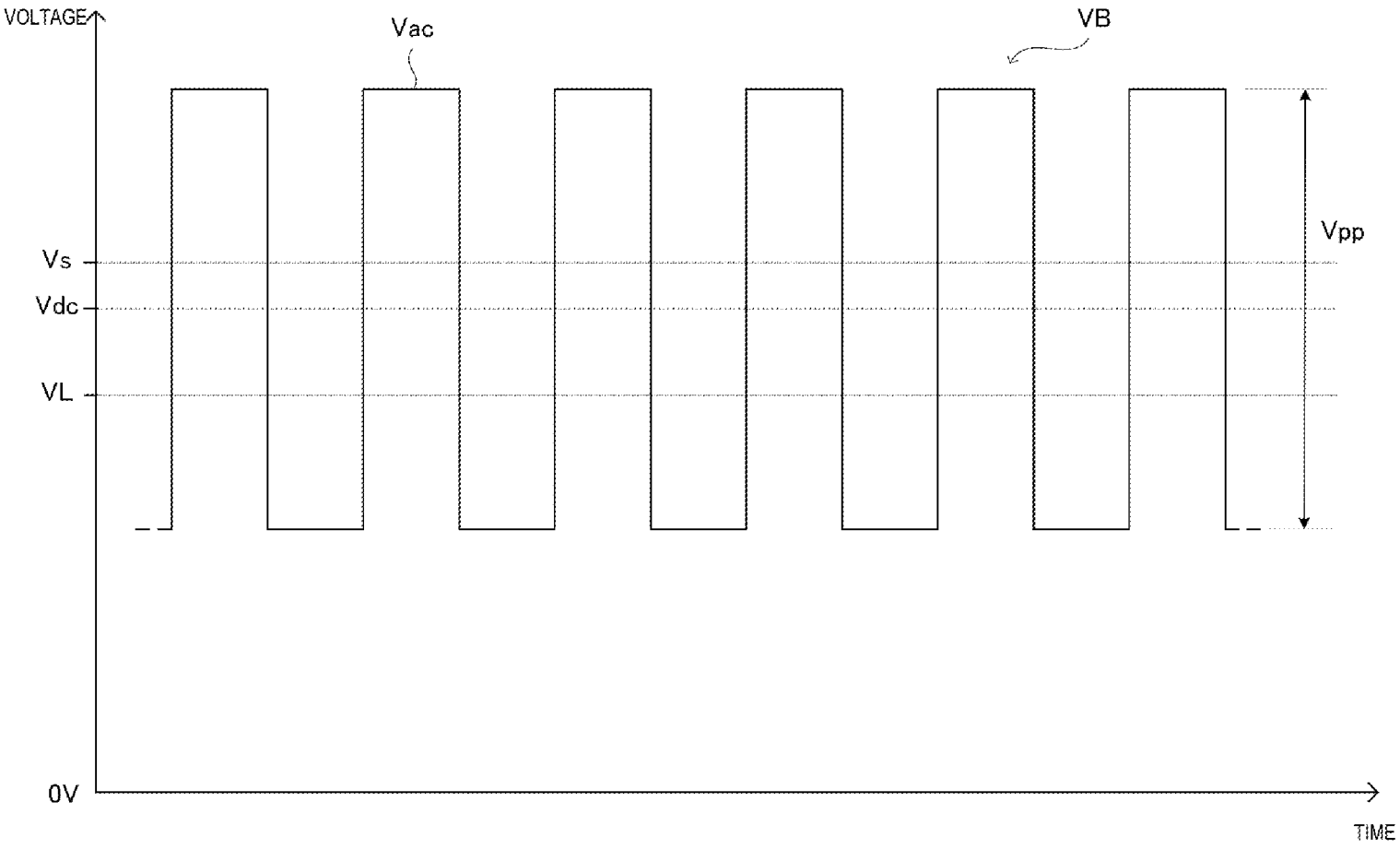
FIG. 4 is an explanatory diagram showing an example of a developing bias waveform of an image forming apparatus according to a first embodiment.

Here, as shown in FIG. 4, the developing bias VB applied between the developing roller 343A and the photoconductor drum 341 is a voltage at which an AC component Vac is superimposed on a DC component Vdc. That is, the development power supply circuit 301A, by superimposing an AC voltage on a DC voltage, generates a developing bias VB in which the AC component Vac is superimposed on the DC component Vdc. Therefore, in the developing bias VB, a variable component due to a pulsation (ripple) of the AC component Vac is superimposed on the value of the DC component Vdc, and based on the value of the DC component Vdc, higher and lower values are periodically repeated. In the example of FIG. 4, the AC component Vac of the developing bias VB is a rectangular wave having a duty ratio of 50%; however, the AC component Vac is not limited to this, and may be, for example, a sine wave or a triangular wave.

In addition, in the developing bias VB, at least the value (magnitude) of the DC component Vdc and the magnitude Vpp of the AC component Vac, which is the peak-to-peak value of the AC component Vac, can be adjusted. As an example, when the surface potential of the photoconductor drum 341 in a charged state is defined as "Vs", and the potential of the image portion of the surface of the photoconductor drum 341 irradiated with light from the laser scanning unit 35 is defined as "VL", the DC voltage Vdc is a value between Vs and VL. That is, the value of the DC voltage Vdc becomes lower than the surface potential Vs and higher than the potential VL of the image portion. The value of the DC component Vdc is set so that, for example, the difference (Vs−Vdc) between the DC component Vdc and the surface potential Vs becomes a predetermined value (for example, 100V).

In the present embodiment, the first carrying member is the developing roller 343A and the second carrying member is the photoconductor drum 341, and thus the developing bias VB is an example of a "bias voltage" applied between the first carrying member and the second carrying member. That is, a developing bias VB, in which an AC component Vac is superimposed on a DC component Vdc, is applied as a "bias voltage" between the first carrying member and the second carrying member. Further, a developing current that flows between the developing roller 343A and the photoconductor drum 341 due to the bias voltage (developing bias VB) being applied is an example of a "target current" flowing between the first carrying member and the second carrying member. The developing current includes a toner current that flows with the movement of the toner. That is, the developing current flows as a "target current" between the first carrying member and the second carrying member. In the present disclosure, target current (developing current) flowing from the first carrying member (developing roller 343A) to the second carrying member (photoconductor drum 341) is defined as "positive" (plus), and conversely, target current flowing from the second carrying member to the first carrying member is defined as "negative" (minus).

Here, a magnet body is arranged inside the developing roller 343A, and the developing roller 343A rotates around the stationary magnet body. One of the magnetic poles of the magnet body faces the photoconductor drum 341 via the developing roller 343A and a developing gap. The developing agent carried on the developing roller 343A forms a magnetic brush in the developing gap. The magnetic brush is a magnetic carrier to which toner is attached. Therefore, the developing current, which is an example of a target current, includes, in addition to toner current that flows with the movement of toner, magnetic brush current flowing through the magnetic brush in the image portion, and reverse magnetic brush current flowing through the magnetic brush in a non-image portion in a direction opposite to the magnetic brush current flowing through the magnetic brush in the image portion.

The primary transfer roller 344 transfers the toner image formed on the surface of the photoconductor drum 341 by the developing device 343 to the outer peripheral surface of an intermediate transfer belt 361 (see FIG. 3). More specifically, the primary transfer roller 344 is electrically connected to the power supply circuit 301, and by receiving a high voltage applied from the power supply circuit 301, transfers the toner image formed on the surface of the photoconductor drum 341 to the outer peripheral surface of the intermediate transfer belt 361. That is, a transfer electric field is formed by a high-voltage transfer bias being applied between the photoconductor drum 341 and the primary transfer roller 344 by the power supply circuit 301, and toner having an electric charge moves from the photoconductor drum 341 to the intermediate transfer belt 361. Thus, a toner image is formed on (transferred to) the outer peripheral surface of the intermediate transfer belt 361.

The drum cleaning portion 345 cleans the surface of the photoconductor drum 341 after the toner image is transferred by the primary transfer roller 344. For example, the drum cleaning portion 345 has a blade-shaped cleaning member and a conveyance member. The cleaning member comes into contact with the surface of the photoconductor drum 341 and removes toner adhering to the surface. The conveyance member conveys the toner removed by the cleaning member to a toner storage container.

A toner container 346 supplies toner to the case of the developing device 343. In the image forming unit 34 that forms the K (black) toner image, the toner container 346 supplies the K (black) toner.

The current detection circuit 302 detects the developing current (an example of the target current) flowing between the photoconductor drum 341 and the developing roller 343A. As an example, the current detection circuit 302 is a circuit including a current sensor such as a shunt resistor or a current transformer, and is provided on a current-flowing path from the power supply circuit 301 to the developing roller 343A. The current detection circuit 302 outputs a detection signal corresponding to the magnitude of the developing current flowing from the developing roller 343A (first carrying member) to the photoconductor drum 341 (second carrying member) to the control portion 5.

In addition, in the present embodiment, the current detection circuit 302 includes a filter circuit 302A. The filter circuit 302A is, for example, a low-pass filter, or in other words, an integrating filter, that attenuates frequency components above a cutoff frequency of the developing current flowing from the developing roller 343A (first carrying member) to the photoconductor drum 341 (second carrying member). By including the filter circuit 302A, the target current detected by the current detection circuit 302 corresponds to the DC component of the developing current flowing from the developing roller 343A to the photoconductor drum 341.

The laser scanning unit 35 forms an electrostatic latent image on each of the photoconductor drums 311, 321, 331, 341 of the four image forming units 31 to 34. In the present embodiment, the laser scanning unit 35 includes two laser scanning units 351 and 352. The laser scanning unit 351, according to input of Y (yellow) image data, irradiates the photoconductor drum 311 with light based on the image data and forms an electrostatic latent image. The laser scanning unit 351, according to input of C (cyan) image data, irradiates the photoconductor drum 321 with light based on the image data and forms an electrostatic latent image. The laser scanning unit 352, according to input of M (magenta) image data, irradiates the photoconductor drum 331 with light based on the image data and forms an electrostatic latent image. In addition, the laser scanning unit 352, according to input of K (black) image data, irradiates the photoconductor drum 341 with light based on the image data and forms an electrostatic latent image.

The toner images of each color formed by each of the plurality of (in this case, four) image forming units 31 to 34 are superimposed and transferred to the outer peripheral surface of the intermediate transfer belt 361. Thus, a color image (toner image) is formed on the outer peripheral surface of the intermediate transfer belt 361.

As shown in FIG. 3, the intermediate transfer device 36 includes the intermediate transfer belt 361, a drive roller 362, a tension roller 363, a belt cleaning member 364, and a density detecting portion 365. The intermediate transfer device 36 uses the intermediate transfer belt 361 to convey the toner image formed by the image forming units 31 to 34 to a transfer position P1 (see FIG. 3) by the secondary transfer roller 37.

The intermediate transfer belt 361 is an endless belt on which toner images of each color are transferred from each of the photoconductor drums 311, 321, 331, 341. As shown in FIG. 3, the intermediate transfer belt 361 is placed around the drive roller 362 and the tension roller 363 arranged apart from each other in the front-rear direction D2 of the image forming apparatus 10. The drive roller 362 receives a driving force supplied from a motor and rotates. Thus, the intermediate transfer belt 361 rotates in the rotation direction D4 shown in FIG. 3. The toner image transferred to the outer peripheral surface of the intermediate transfer belt 361 is conveyed to the transfer position P1 by the secondary transfer roller 37 as the intermediate transfer belt 361 rotates. The belt cleaning portion 364 cleans the outer peripheral surface of the intermediate transfer belt 361 after the toner image is transferred at the transfer position P1.

The density detecting portion 365 detects the density of the image (toner image) transferred to the outer peripheral surface of the photoconductor drum 341 or the intermediate transfer belt 361. For example, the density detecting portion 365 includes a reflective-type optical sensor having a light emitting portion that outputs light toward the outer peripheral surface of the intermediate transfer belt 361, and a light receiving unit that receives light that is outputted from the light emitting unit and reflected by the outer peripheral surface of the intermediate transfer belt 361. As shown in FIG. 3, the density detecting portion 365 is arranged on the downstream side of the image forming unit 34 in the rotation direction D4 of the intermediate transfer belt 361 and on the upstream side of the secondary transfer roller 37. In addition, the density detecting portion 365 is arranged so as to face one end portion in a width direction (left-right direction D3) of the intermediate transfer belt 361 on the outer peripheral surface of the intermediate transfer belt 361. The density detecting portion 365 may be arranged so as to face both ends in the width direction of the intermediate transfer belt 361 on the outer peripheral surface of the intermediate transfer belt 361.

The secondary transfer roller 37 transfers the toner image formed on the outer peripheral surface of the intermediate transfer belt 361 to a sheet supplied by the sheet feed portion 4. As shown in FIG. 3, the secondary transfer roller 37 is arranged so as to be in contact with the outer peripheral surface of the intermediate transfer belt 361 at a position facing the tension roller 363 with the intermediate transfer belt 361 interposed therebetween. The secondary transfer roller 37 is pressed toward the tension roller 363 side by a pressing member. The secondary transfer roller 37 is electrically connected to the power supply circuit, and by receiving a high voltage applied from the power supply circuit, transfers the toner image formed on the outer peripheral surface of the intermediate transfer belt 361 to a sheet passing through the transfer position P1 (see FIG. 3) where the secondary transfer roller 37 and the intermediate transfer belt 361 come into contact.

The length of the secondary transfer roller 37 in the axial direction (left-right direction D3) is shorter than the width of the intermediate transfer belt 361. Thus, on the outer peripheral surface of the intermediate transfer belt 361, a contact region that contacts the secondary transfer roller 37 and non-contact regions (margin regions) that do not contact the secondary transfer roller 37 are generated. The non-contact regions are regions on both outer sides of the contact region on the outer peripheral surface of the intermediate transfer belt 361. The density detecting portion 365 is arranged so as to face one of the non-contact areas. The secondary transfer roller 37 transfers the image formed in the contact region of the images formed on the outer peripheral surface of the intermediate transfer belt 361 to the sheet, and does not transfer the images formed in the non-contact regions to the sheet. The length in the axial direction of the secondary transfer roller 37 may be the same as the width of the intermediate transfer belt 361.

The fixing device 38 melts and fixes the toner image transferred to the sheet by the secondary transfer roller 37 to the sheet. For example, the fixing device 38 includes a fixing roller and a pressure roller. The fixing roller is arranged so as to be in contact with the pressure roller, and heats the toner image transferred to the sheet to fix the toner image on the sheet. The pressure roller applies pressure to the sheet passing through the contact portion formed between the pressure roller and the fixing roller.

The sheet after image formation is discharged to the sheet discharge tray 39.

As related art, a technique is known in which, in an image forming apparatus, a surface potential on a photoconductor is found and used as feedback to control charging of the photoconductor. That is, in an electrophotographic type image forming apparatus (electrophotographic apparatus), a charged photoconductor is exposed based on image data, and an electrostatic latent image is formed on the photoconductor. The image forming apparatus applies a bias voltage to a developing roller, and by supplying charged toner to the photoconductor according to an electric field between the developing roller and photoconductor, causes the toner to adhere to an exposed portion on the photoconductor, and forms an image by developing the electrostatic latent image on the photoconductor.

In this type of image forming apparatus, fluctuations in the surface potential (charging potential) of the photoconductor affect the image quality, and thus in the image forming apparatus according to the related art, the surface potential of the photoconductor is found, and charging of the photoconductor is controlled so that a constant surface potential is obtained. Here, the image forming apparatus according to the related art forms a pulse-shaped electrostatic potential pattern on the photoconductor, detects a current corresponding to a switching point of the electrostatic potential pattern, and finds the surface potential on the photoconductor based on the current.

However, in the configuration of the related art, the state of the surface potential is estimated by the developing current generated at the place where the surface potential is switched, and thus, for example, in a case where the film thickness of the photoconductor changes or the charger deteriorates, an error may occur in the found surface potential.

On the other hand, in the image forming apparatus 10 according to the present embodiment, it is possible to improve the measurement accuracy of the surface potential by the configuration described below.

That is, as shown in FIG. 1, the image forming apparatus 10 according to the present embodiment includes an image forming portion 3, an AC setting processing portion 51, a potential measurement processing portion 52, and a drive processing portion 53. In the present embodiment, as an example, the AC setting processing portion 51, the potential measurement processing portion 52, and the drive processing portion 53 are provided in the control portion 5 as one function of the control portion 5.

As described above, the image forming portion 3 applies a bias voltage (developing bias VB) between the first carrying member (developing roller 343A) and the second carrying member (photoconductor drum 341) to move toner from the first carrying member to the second carrying member and form an image on the second carrying member. Here, the bias voltage is a voltage in which the AC component Vac is superimposed on the DC component Vdc. The AC setting processing portion 51 performs AC calibration for setting the magnitude Vpp of the AC component Vac of the bias voltage (developing bias VB). The potential measurement processing portion 52 measures the surface potential Vs of the first carrying member or the second carrying member based on the target current (developing current) flowing between the first carrying member and the second carrying member. In a case where the drive processing portion 53 measures the surface potential Vs and an activation condition is satisfied, the drive processing portion 53 executes AC calibration before the measurement of the surface potential Vs.

In the present embodiment, the first carrying member is the developing roller 343A and the second carrying member is the photoconductor drum 341, and thus the developing bias VB is an example of the "bias voltage" and the developing current is an example of the "target current". The potential measurement processing portion 52 measures (calculates) the surface potential Vs of the photoconductor drum 341, which is the second carrying member of the first carrying member developing roller 343A) and the second carrying member (photoconductor drum 341).

According to the configuration described above, the image forming apparatus 10 measures the surface potential Vs based on the target current (developing current in the present embodiment), and thus the surface potential Vs can be measured by absorbing various fluctuations due to a change in the film thickness of the photoconductor drum 341 or deterioration of the charging roller 342. Particularly, when measuring the surface potential Vs, the image forming apparatus 10 can optimize the magnitude Vpp of the AC component Vac of the bias voltage (developing bias VB) by executing AC calibration in advance. That is, by measuring the surface potential Vs after performing AC calibration that sets the magnitude Vpp of the AC component Vac of the bias voltage, the image forming apparatus 10 can optimize the magnitude Vpp of the AC component Vac at the time of measuring the surface potential Vs. As a result, with the image forming apparatus 10, it is possible to improve the measurement accuracy of the surface potential Vs.

[3] Configuration of Control Portion

Next, each functional portion included in the control portion 5 will be described in more detail with reference to FIG. 1. The control portion 5 includes the AC setting processing portion 51, the potential measurement processing portion 52, the drive processing portion 53, a DC setting processing portion 54, and a potential adjustment processing portion 55. That is, the image forming apparatus 10 includes, in addition to the AC setting processing portion 51, the potential measurement processing portion 52, and the drive processing portion 53, a DC setting processing portion 54 and a potential adjustment processing portion 55 as one function of the control portion 5.

The AC setting processing portion 51 performs AC calibration for setting the magnitude Vpp (peak-to-peak voltage) of the AC component Vac of the bias voltage (developing bias VB). Here, the AC setting processing portion 51 sets the magnitude Vpp of the AC component Vac to a value in which the change in the developing current is small even when the magnitude Vpp of the AC component Vac changes, or in other words, to a value in which the change in the toner development amount is small.

On the other hand, the DC setting processing portion 54 performs DC calibration for setting the magnitude of the DC component Vdc of the bias voltage (developing bias VB). Here, the DC setting processing portion 54 sets the magnitude of the DC component Vdc based on density of the toner image. The density of the toner image is optically detected by the density detecting portion 365, for example, on the photoconductor drum 341 or the intermediate transfer belt 361. More specifically, a correlation between the DC component Vdc and a halftone image density is found by the density detecting portion 365, and from that correlation, the DC setting processing portion 54 finds the magnitude of the DC component Vdc that becomes the target image density. Thus, relatively high-quality image formation becomes possible.

Here, the DC setting processing portion 54 executes DC calibration after measurement of the surface potential Vs. In short, the image forming apparatus 10 performs a procedure of first executing AC calibration for setting the magnitude Vpp of the AC component Vac of the bias voltage, measuring the surface potential Vs, and then executing DC calibration for setting the magnitude of the DC component Vdc. Thus, in the image forming apparatus 10 according to the present embodiment, it is easy to set the magnitude of the DC component Vdc to an appropriate value according to the measurement result of the surface potential Vs.

In the present embodiment, the AC setting processing portion 51 sets the magnitude Vpp of the AC component Vac based on the target current (developing current). More specifically, the AC setting processing portion 51 sequentially sets the magnitude Vpp of the AC component Vac to a plurality of values within a predetermined range, and causes the current detection circuit 302 to detect the developing current that flows when developing a solid black image. The AC setting processing portion 51 determines an appropriate magnitude Vpp of the AC component Vac from this change in developing current. As the DC component Vdc of the developing bias VB used in the AC calibration, the value of the DC component Vdc set in the latest DC calibration is adopted. When measuring the developing current, a solid black latent image is used. In addition, the developing current is preferably measured by the developing roller 343A with an average current for one rotation or more, and more preferably with an average current for an integral multiple of one rotation of the developing roller 343A.

In short, the image forming apparatus 10 according to the present embodiment performs AC calibration based on the developing current, and performs DC calibration based on the optically detected density. The reason for this is that in AC calibration a condition is adopted in which the saturation density of the image is stable, and in DC calibration a method for setting the saturation density level is selected. This method can stabilize the image quality most. That is, when trying to set a condition that will stabilize the saturation density of the image, the saturation density of the image must be measured; however, since the measurement sensitivity of an optical sensor is low at the saturation density, there is a problem in that measurement error tends to be large. Therefore, in the present embodiment, this problem is solved by using the developing current instead of the image density for the AC calibration.

Further, in a case of developing the toner, the DC component of the developing current includes the toner current accompanying the movement of the toner and the current flowing through the magnetic brush; however, at the same time, the reverse magnetic brush current flows in the opposite direction in the non-image portion (reserved portion). Therefore, the AC setting processing portion 51 measures the developing current while changing the magnitude Vpp of the AC component Vac, and from the changed state, finds the magnitude Vpp of the AC component Vac such that the image density peaks.

In this embodiment, in particular, the AC setting processing portion 51 determines the magnitude Vpp of the AC component Vac based on the target current when a bias voltage is applied by changing the magnitude Vpp of the AC component Vac within a first measurement range, and the target current when a bias voltage is applied by changing the magnitude Vpp of the AC component Vac within a second measurement range. Here, the second measurement range is a range on a higher frequency side than the first measurement range. In this way, it is possible to set the optimum magnitude Vpp of the AC component Vac by dividing the variable range of the magnitude Vpp of the AC component Vac into a first measurement range and a second measurement range, acquiring the relationship between the magnitude Vpp of the AC component Vac and the developing current in each range, and considering the relationships obtained in each range.

The potential measurement processing portion 52 measures the surface potential Vs of the photoconductor drum 341 based on the target current (developing current) flowing between the first carrying member (developing roller 343A) and the second carrying member (photoconductor drum 341). That is, the potential measurement processing portion 52 performs measurement of the surface potential Vs based on the developing current detected by the current detection circuit 302. More specifically, the potential measurement processing portion 52 utilizes the fact that the DC component of the developing current becomes 0 (zero) in a case where the surface potential Vs and the DC component Vdc of the bias voltage (developing bias VB) match. That is, the potential measurement processing portion 52 specifies the DC component Vdc of the bias voltage (developing bias VB) when the DC component of the developing current is 0 as the surface potential Vs.

In a case where an activation condition is satisfied when measuring the surface potential Vs, the drive processing portion 53 executes AC calibration before the measurement of the surface potential Vs. That is, the drive processing portion 53 basically controls the timing of driving the AC setting processing portion 51 and the potential measurement processing portion 52 so that AC calibration is executed before the measurement of the surface potential Vs. The "activation condition" referred to here is a condition for executing AC calibration, and in a case where the activation condition is satisfied, the drive processing portion 53 always causes the AC setting processing portion 51 to execute AC calibration before measuring the surface potential Vs. On the other hand, in a case where the activation condition is not satisfied, the drive processing portion 53 does not cause the AC setting processing portion 51 to execute the AC calibration even before the measurement of the surface potential Vs.

In the present embodiment, the activation condition includes that the surface potential Vs has been measured a predetermined number of times since the previous AC calibration. Thus, the drive processing portion 53 causes the AC calibration to be executed once every time the surface potential Vs has been measured a predetermined number of times. For example, in a case where the predetermined number of times is "two times", AC calibration is performed every time the surface potential Vs has been measured two times. In the present embodiment, as an example, the predetermined number of times is "one time". Therefore, AC calibration is performed every time before the measurement of the surface potential Vs. According to this configuration, the execution frequency of the AC calibration can be adjusted according to the activation condition.

Here, in order to improve the accuracy of the measurement of the surface potential Vs, the AC component Vac of the developing bias VB applied at the time of measurement is preferably the same as the AC component Vac of the developing bias VB used at the time of image formation (during development). This is because the AC component Vac of the developing bias VB has a function of changing the surface potential Vs by injecting a charge into the photoconductor drum 341. Therefore, it is preferable that the AC component Vac of the developing bias VB be set to a value that stabilizes the movement of the toner. Thus, excessive charge injection into the photoconductor drum 341 is also suppressed, and the photoconductor drum 341 can be used in a stable state. AC calibration sets the AC component Vac of such a developing bias VB.

The potential adjustment processing portion 55 adjusts the surface potential Vs based on the surface potential Vs measured by the potential measurement processing portion 52. More specifically, the potential adjustment processing portion 55 sets the magnitude of the voltage applied to the charging roller 342 by the charging power supply circuit 301B based on the surface potential Vs measured by the potential measurement processing portion 52. Thus, the image forming apparatus 10 can maintain the surface potential Vs in an appropriate state, and can suppress deterioration of image quality due to fluctuations or unevenness of the surface potential Vs.

[4] Control Method of Image Forming Apparatus

Hereinafter, the control method of the image forming apparatus 10 executed by the control portion 5 in the image forming apparatus 10 will be described with reference to the flowchart of FIG. 5. Here, steps S1, S2, and so on represent the number of the processing procedure (step) executed by the control portion 5.

Figure 5:
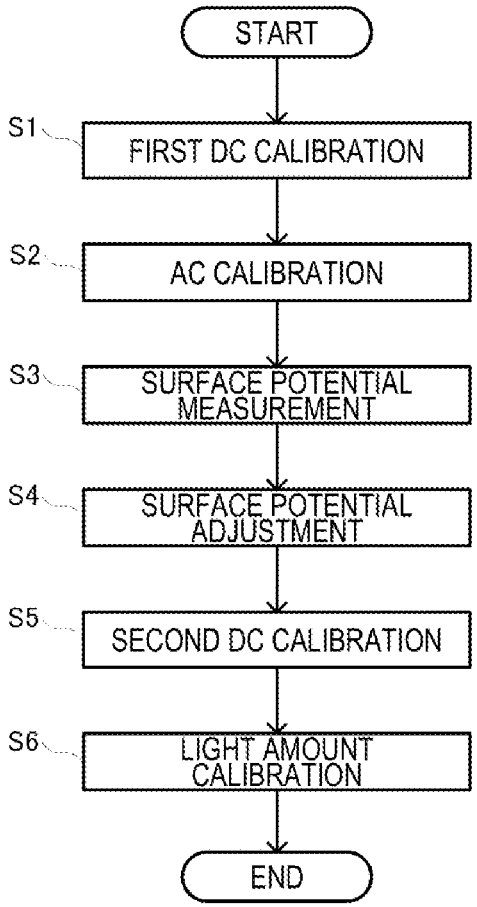
FIG. 5 is a flowchart showing an example of operation of an image forming apparatus according to a first embodiment.

The process shown in FIG. 5 is executed in a case where a predetermined trigger condition is satisfied. The predetermined trigger condition is, for example, when printing of a fixed number of sheets (5,000 sheets as an example) is completed, or when a specific environmental condition (for example, a temperature of 30 degrees or more and a humidity of 80% or more) is satisfied when the power is turned ON. In addition, although a control method for the K (black) toner is exemplified here, the control portion 5 executes the same process for Y (yellow), C (cyan), and M (magenta).

<Step S1>

First, in step S1, the DC setting processing portion 54 of the control portion 5 executes a first DC calibration for setting the magnitude of the DC component Vdc (pre-DC calibration process). That is, in step S1, the DC setting processing portion 54 sets the magnitude of the DC component Vdc based on the density of the toner image. The first DC calibration executed before execution of the AC calibration is an example of the pre-DC calibration, and a second DC calibration (S5) (not the pre-calibration) executed after execution of the AC calibration is an example of DC calibration. In the first DC calibration, a value used until immediately before or a preset value is used as the magnitude Vpp of the AC component Vac of the developing bias VB.

That is, in the present embodiment, the DC setting processing portion 54, before executing AC calibration, executes pre-calibration (first DC calibration) for setting the magnitude of the DC component Vdc separately from DC calibration (second DC calibration). As described above, in the present embodiment, the DC setting processing portion 54 executes DC calibration (first DC calibration and second DC calibration) before and after AC calibration, respectively. Thus, in AC calibration (S2), by using the DC component Vdc set in the pre-calibration, it becomes easy to appropriately set the magnitude of the AC component Vac.

<Step S2>

In step S2, the AC setting processing portion 51 of the control portion 5 executes AC calibration for setting the magnitude Vpp of the AC component Vac (AC calibration process). At this time, the control portion 5 adopts the value of the DC component Vdc set in the pre-calibration (S1) as the DC component Vdc of the developing bias VB. That is, in step S2, the AC setting processing portion 51 sets the magnitude Vpp of the AC component Vac based on the target current (developing current) detected by the current detection circuit 302. Details of the AC calibration will be described in "[5] Details of Each Process".

<Step S3>

In step S3, the potential measurement processing portion 52 of the control portion 5 measures the surface potential Vs of the photoconductor drum 341 based on the target current (developing current) flowing between the developing roller 343A and the photoconductor drum 341 (surface potential measurement process). At this time, the control portion 5 adopts the value of the DC component Vdc set in the pre-calibration (S1) as the DC component Vdc of the developing bias VB, and adopts the value (Vpp) set in the AC calibration (S2) as the AC component Vac. Details of the method for measuring the surface potential Vs will be described in "[5] Details of Each Process".

<Step S4>

In step S4, the potential adjustment processing portion 55 of the control portion 5 adjusts the surface potential Vs of the photoconductor drum 341 (potential adjustment process). At this time, the potential adjustment processing portion 55 adjusts the magnitude of the voltage applied to the charging roller 342 by the charging power supply circuit 301B based on the surface potential Vs measured in step S3, and adjusts the surface potential Vs to an appropriate value.

<Step S5>

Next, in step S5, the DC setting processing portion 54 of the control portion 5 executes the second DC calibration for setting the magnitude of the DC component Vdc (DC calibration process). That is, in step S5, the DC setting processing portion 54 sets the magnitude of the DC component Vdc based on the density of the toner image. In the second DC calibration, the value determined in the immediately preceding AC calibration (S2) is used as the magnitude Vpp of the AC component Vac of the developing bias VB. However, in a case where an upper limit value and a lower limit value are set for the magnitude Vpp of the AC component Vac, the magnitude Vpp of the AC component Vac is defined within the range of the upper limit value and the lower limit value. Details of DC calibration will be described in "[5] Details of Each Process".

<Step S6>

In step S6, the control portion 5 performs control of the laser scanning unit 35 and executes a light amount calibration for adjusting the exposure amount (light amount calibration process). With this, the control portion 5 ends the series of processes.

Figure 8:
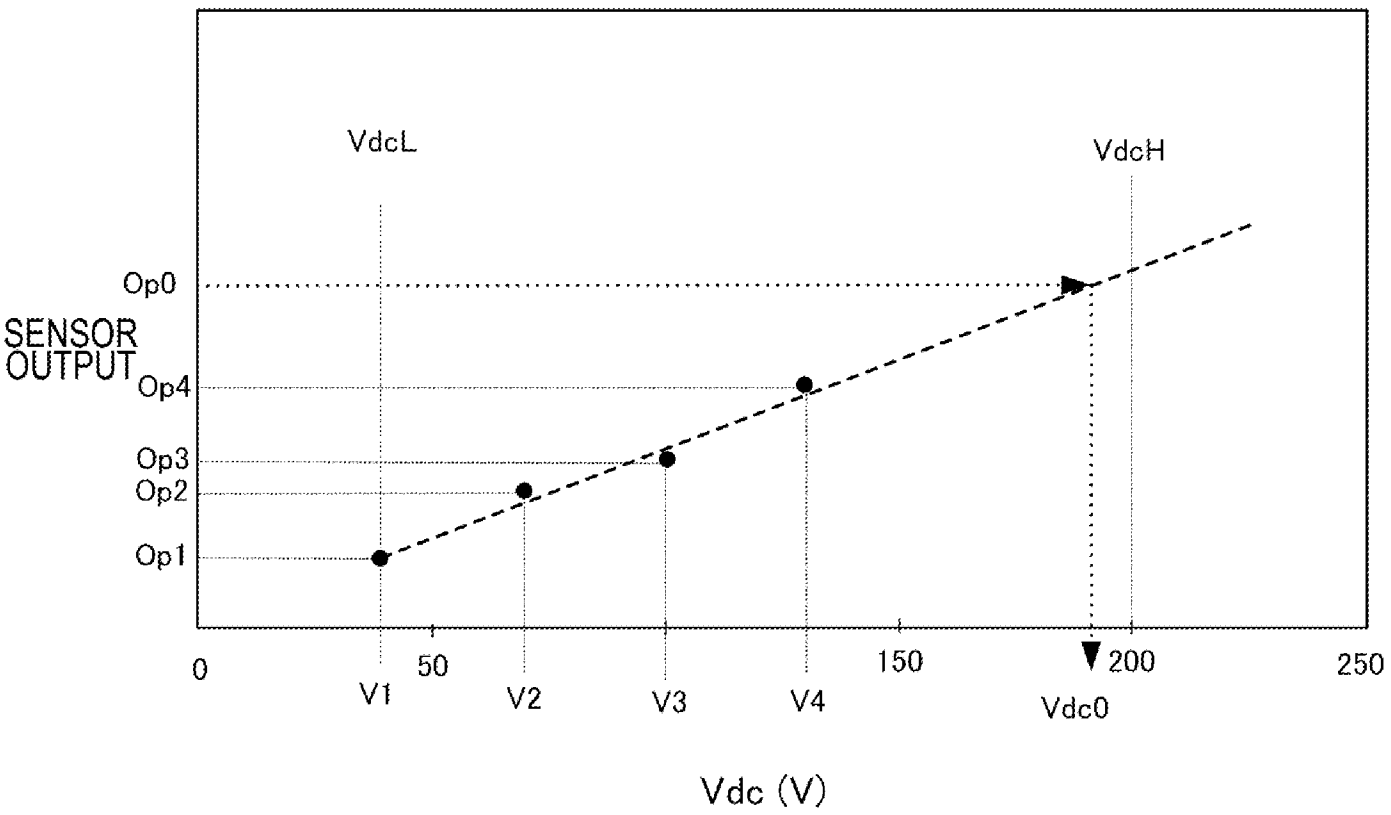
FIG. 8 is an explanatory diagram showing an example of DC calibration in an image forming apparatus according to a first embodiment.

The procedure of the current detection method described above is only an example, and the order of the processes shown in the flowchart of FIG. 8 may be changed as appropriate, or processes may be added or omitted as appropriate. For example, it is not essential for the DC setting processing portion 54 to execute the pre-calibration (second calibration) for setting the magnitude of the DC component Vdc separately from the DC calibration (S5) before executing the AC calibration. Therefore, the first DC calibration (S1) may be omitted.

In addition, the AC calibration performed by the AC setting processing portion 51 and the DC calibration performed by the DC setting processing portion 54 may also be executed, for example, in a case where the following individual trigger conditions are satisfied in addition to the flowchart described above. Examples of individual trigger conditions for AC calibration include when printing of a fixed number of sheets (1000 sheets as an example) has been completed, when a specific environmental condition (as an example, temperature of 30 degrees or more and humidity of 80% or more) is satisfied when the power is turned ON, or the like. Further, individual trigger conditions for AC calibration may also include when the value of the DC component Vdc becomes higher than the current value of the DC component Vdc by a predetermined value (30 V as an example) or more after the DC calibration, when the value of the DC component Vdc reaches the set lower limit value or the set upper limit value, or the like Examples of individual trigger conditions for DC calibration include when, after the power is turned ON, the paper feed period of the image forming apparatus 10 reaches a predetermined time (4 hours as an example), when the number of continuous prints reaches a fixed number (200 sheets as an example), when the temperature inside the image forming apparatus 10 changes by a fixed value (10 degrees as an example) or more, or the like.

[5] Details of Each Process

Figure 6:
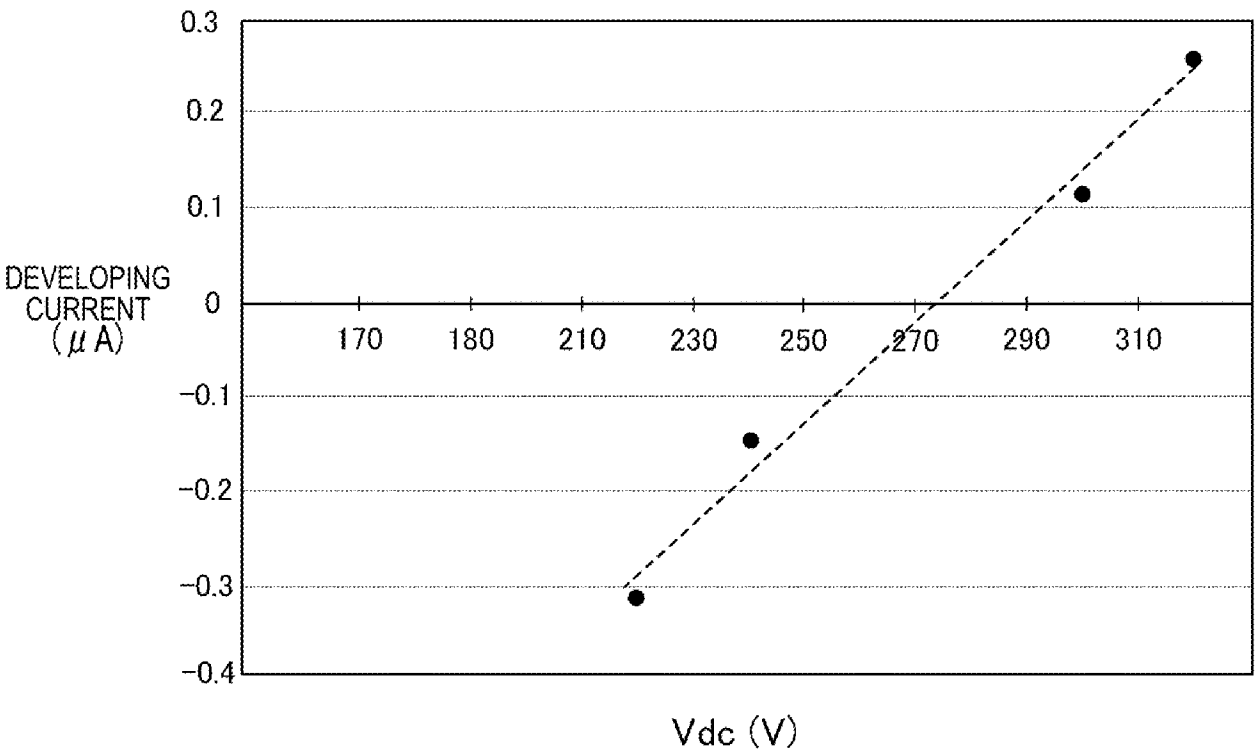
FIG. 6 is an explanatory diagram showing an example of a method for measuring surface potential in an image forming apparatus according to a first embodiment.

Hereinafter, details of each process executed by the control portion 5 in the image forming apparatus 10 will be described with reference to FIGS. 6 to 8.

[5.1] Measurement of Surface Potential

There are multiple methods for measuring (calculating) the surface potential Vs based on the developing current. A first method is a method in which the DC component Vdc when the DC component of the developing current is 0 (zero) is set as the value of the surface potential Vs. A second method is a method in which the developing bias VB is applied in a state where the surface potential Vs is placed on the photoconductor drum 341, and the DC component Vdc, when the developing current flowing in a case where the DC component Vdc is changed becomes the same value as the target current, is defined as the value of the surface potential Vs. In the second method, when determining the target current, the DC component Vdc of the developing bias VB is set to 0 in a state in which the surface potential Vs not placed on the photoconductor drum 341, and the DC component of the developing current when applied only as the AC component Vac is set as the target current.

The first method is simple in that it is not necessary to measure the target current in advance as in the second method; however, the first method is affected by a difference in lengths of the photoconductor drum 341 and the developing roller 343A. For example, there is a portion where the developing roller 343A and the photoconductor drum 341 face via a magnetic brush, and a portion, such as an end portion of the developing roller 343A, that faces the photoconductor drum 341 not via a magnetic brush. As a result, the DC component Vdc when the DC component of the developing current is 0 (zero) is not exactly the value of the surface potential Vs. Strictly considering this point, the second method is superior. In addition, by setting the target current not only at the beginning but also during use, higher measurement accuracy can be ensured.

In the present embodiment, the potential measurement processing portion 52 performs measurement of the surface potential Vs by the first method. For example, as shown in FIG. 6, the potential measurement processing portion 52, while sweeping the DC component Vdc of the bias voltage (developing bias VB), specifies the magnitude of the DC component Vdc when the DC component of the developing current becomes 0 (zero). In the example of FIG. 6, the DC component Vdc is 272V and the developing current becomes 0, and thus the potential measurement processing portion 52 specifies this DC component Vdc (272V) as the surface potential Vs.

Here, in a two-component developing method, the developing current includes a carrier current and a toner current, and the carrier current may flow even in a state where there is almost no movement of the toner. The direction in which the carrier current flows is determined by a difference between the potential of the developing roller 343A and the surface potential Vs of the photoconductor drum 341. That is, when the potential of the developing roller 343A is higher than the surface potential Vs of the photoconductor drum 341, the developing current becomes a "positive" current flowing from the developing roller 343A to the photoconductor drum 341. Conversely, when the potential of the developing roller 343A is lower than the surface potential Vs of the photoconductor drum 341, the developing current becomes a "negative" current flowing from the photoconductor drum 341 to the developing roller 343A.

Therefore, in a state in which the surface potential Vs is placed on the photoconductor drum 341, the potential of the developing roller 343A is changed stepwise to obtain the developing current, and a correlation between the potential of the developing roller 343A and the developing current is found, and when finding the potential of the developing roller 343A when the developing current becomes 0, the value becomes the surface potential Vs. However, when the difference between the surface potential Vs and the potential of the developing roller 343A becomes large, the prediction accuracy of the surface potential Vs is lowered because of the influence of the toner current due to the movement of the toner. Therefore, it is preferable that the difference between the surface potential Vs and the potential of the developing roller 343A be small. However, when the potential difference is too small, the resolution of the developing current is lowered, and in the end there is a problem in measurement accuracy.

Therefore, more preferably, the fluctuation range of the DC component Vdc is set so as to sandwich the surface potential Vs above and below with respect to the expected surface potential Vs. The direction of the developing current is reversed in a case where the DC component Vdc is higher than the surface potential Vs and in a case where the DC component Vdc is lower than the surface potential Vs. Therefore, the surface potential Vs can be specified in a case where the potential measurement processing portion 52 acquires the change in the developing current when the DC component Vdc is changed within the fluctuation range and specifies the DC component Vdc at which the developing current becomes 0. In this case, the DC component Vdc is set so as to sandwich the surface potential Vs (as an example, the potential difference is preferably within 100 V, more preferably within 50 V), and thus It becomes easier to set conditions that eliminate the phenomenon that causes an error in the developing current, and the measurement accuracy is improved.

In addition, when measuring the surface potential Vs, it is preferable to use a sine wave (Sin wave) rather than a square wave as the AC component Vac of the developing bias VB. The reason for this is that in the case of a rectangular wave, the impedance in the developing region changes due to a change in the developing agent resistance or the developing gap, and the bias waveform is likely to be distorted. The distortion of this bias waveform affects the developing current. On the other hand, in the case of a sine wave, such an effect is not easily received, and thus it is possible to stably measure the developing current. However, in a case of performing development, a rectangular wave is more advantageous than a sine wave because the efficiency of moving toner is higher. Therefore, as the image forming apparatus 10, it is more preferable that the power supply circuit 301 be able to switch between two types of waveforms, a square wave and a sine wave, as the AC component Vac.

In addition, in the present embodiment, the photoconductor drum 341 is a so-called a-Si drum in which an amorphous silicon film is formed on the peripheral surface of the core material. In this case, as shown in FIG. 6, the developing current is linearly approximated on the positive (plus) side and the negative (minus) side, and becomes the surface potential Vs at which the developing current becomes zero. On the other hand, in a case where the photoconductor drum 341 is an organic photoconductor (OPC), there is a difference in the ease of flow of the developing current between the positive side and the negative side. Therefore, it is preferable that the surface potential Vs be the midpoint between the point where the developing current becomes 0 in the linear approximation on the positive side and the point where the developing current becomes 0 in the linear approximation on the negative side.

In addition, it is preferable that the developing current be measured on the development power supply circuit 301A side that applies the developing bias VB. The developing current accompanying the movement of the toner may also be detected on the photoconductor drum 341 side; however, since the current also flows into the photoconductor drum 341 from a charging member or a transfer member, it is difficult to separate the toner current. Therefore, it is desirable to measure the developing current on the development power supply circuit 301A side.

[5.2] AC Calibration

<Changes in Toner Adhesion Amount and Changes in Developing Current>

When the charge amount, the development gap, or the like of the toner changes, the moving force of the toner due to the electric field changes and the image density fluctuates; however, the AC component Vac and the DC component Vdc of the developing bias VB show different characteristics. Regarding the AC component Vac, when the magnitude Vpp is increased, the image density increases; however, eventually the increase in the image density mostly disappears, and when the magnitude Vpp is further increased, the image density, on the contrary, decreases. On the other hand, regarding the DC component Vdc, when the difference (Vdc−VL) from the potential VL of the image portion is increased, the image density continues to increase, and even when the DC component Vdc continues to be increased, the rate of increase in the image density decreases; however, it has not been confirmed that the image density decreases. This is because the electric field due to the AC component Vac is a reciprocating electric field, whereas the electric field due to the DC component Vdc is a unidirectional electric field.

More specifically, regarding the AC component Vac, there is an electric field in the opposite direction of the developing electric field and the recovery electric field. When the magnitude Vpp of the AC component Vac increases, both electric fields rise; however, the amount of toner movement due to the developing electric field eventually reaches an upper limit. After that, when the magnitude Vpp of the AC component Vac further increases, the amount of toner recovered increases due to the rise in the recovery electric field; however, the amount of toner movement on the developing electric field side has reached the upper limit, and thus the amount of toner movement from the developing roller 343A to the photoconductor drum 341 does not change. As a result, the total amount of toner movement decreases.

As described above, the behavior of the developed amount when the magnitude Vpp of the AC component Vac is increased has been clarified; however, how the developing current changes has not been clarified. This is because, the developing current includes a toner current that flows with the movement of the toner, a magnetic brush current that flows through the magnetic brush in the image portion, and a reverse magnetic brush current that flows through the magnetic brush in the non-image portion in a direction opposite to the current flowing in the image portion. That is, when the magnitude Vpp of the AC component Vac is increased, the toner current increases and then decreases; however, since both the magnetic brush current and the reverse magnetic brush current continue to increase in opposite directions, it was not clear how the developing current behaves as a whole.

Therefore, the present disclosers decided to confirm the developing current when the magnitude Vpp of the AC component Vac is increased. As a result, it became clear that the developing current rises as the magnitude Vpp of the AC component Vac increases, but eventually the change becomes smaller, and there is a first behavior of remaining as is with hardly any change, a second behavior of further continuing to rise more slowly, and conversely, a third behavior of decreasing (se FIG. 7).

Regarding the magnitude Vpp of the AC component Vac, it is preferable that the magnitude Vpp be set in a region where the change in image density is small. This is because, under that condition, even in a case where the amount of charge or the development gap of the toner changes, the change in image density is small. It became clear that, as shown in FIG. 7, the magnitude Vpp of the AC component Vac is shown at an intersection of a first approximation formula F1 and a second approximation formula F2 obtained in a first measurement range R1 and a second measurement range R2, respectively. In addition, this stable state also changes with the setting of the DC component Vdc. That is, when the DC component Vdc changes, the optimum value of the magnitude Vpp of the AC component Vac also changes. Therefore, it is preferable that the setting of the DC component Vdc (DC calibration) and the setting of the magnitude Vpp of the AC component Vac (AC calibration) be performed as a set.

<Vpp Setting Method>

Figure 7:
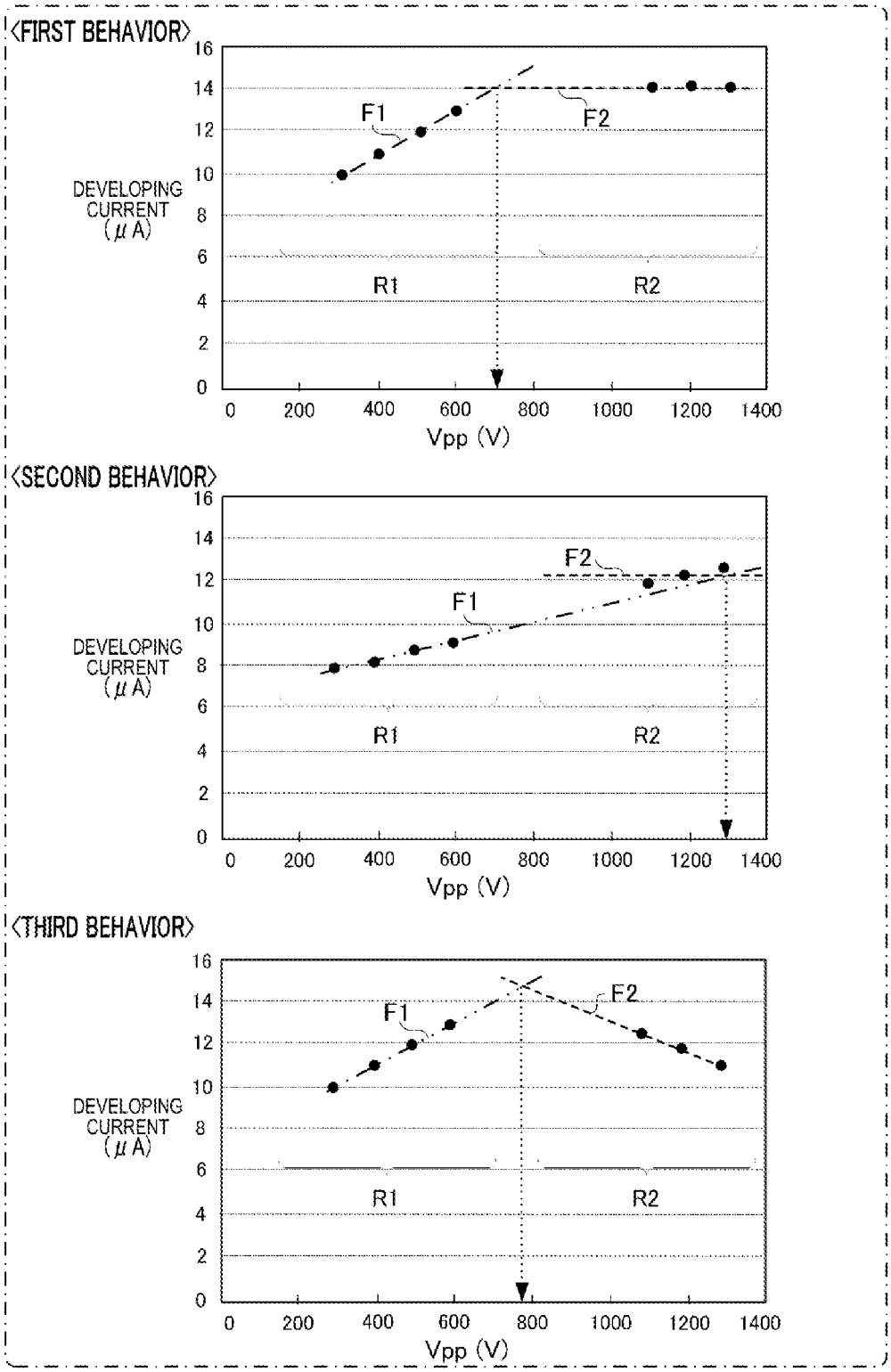
FIG. 7 is an explanatory diagram showing an example of AC calibration in an image forming apparatus according to a first embodiment.

As a specific method, as shown in FIG. 7, the AC setting processing portion 51 first changes the magnitude Vpp of the AC component Vac of the developing bias VB within the first measurement range R1 (Vp1, Vp2, Vp3, Vp4), and acquires the respective developing currents at that time. After that, the AC setting processing portion 51 changes the magnitude Vpp of the AC component Vac of the developing bias VB within the second measurement range R2 higher than the first measurement range R1 (Vp5, Vp6, Vp7), and acquires the respective developing currents at that time. After that, the AC setting processing portion 51 creates the first approximation formula F1 from a plot found in the first measurement range R1 in a graph in which the horizontal axis is the magnitude Vpp of the AC component Vac and the vertical axis is the developing current, and creates the second approximation formula F2 from a plot found in the second measurement range R2. The AC setting processing portion 51 then sets the value (Vpp) at the intersection of the first approximation formula F1 and the second approximation formula F2 as a "reference value", and based on the reference value, sets the magnitude Vpp of the AC component Vac.

Of these, the first approximation formula F1 is a linear approximation formula of the plot obtained within the first measurement range R1, and the slope is "positive". For the second approximation formula F2, a first-order approximation formula of the plot obtained within the second measurement range R2 is found, and in a case where the slope of the first-order approximation formula is "equal to or greater than a fixed value", the first-order approximation formula is used as is as the second approximation formula F2. In a case where the slope of the first-order approximation formula is "less than a fixed value", the first-order approximation formula in which the average of the developing currents of the plot obtained in the second measurement range R2 is the y-intercept value of the first-order approximation formula and the slope is "0" is used for the second approximation formula F2. The fixed value here is "0" as an example. The AC setting processing portion 51 then finds a Vpp (reference value) at a point where the first approximation formula F1 and the second approximation formula F2 intersect.

In addition, the AC setting processing portion 51 does not acquire the developing current between the upper limit value (of Vpp) of the first measurement range R1 and the lower limit value (of Vpp) of the second measurement range R2. Therefore, in order to improve the calculation accuracy of the first approximation formula F1 and the second approximation formula F2 and to find the intersection point correctly, it is necessary to widen the interval between the upper limit value of the first measurement range R1 and the lower limit value of the second measurement range R2 with respect to the average interval of Vpp used for the measurement in the first measurement range R1 and the average interval of Vpp used for the measurement in the second measurement range R2.

In addition, in order to set the magnitude Vpp of the AC component Vac in a region where the image density is stable, a simple method is to perform the setting by reading the image density; however, sensors that measure the image density of the toner on the photoconductor drum 341 or on the intermediate transfer belt 361 have a lower measurement accuracy as the image density increases. Therefore, the setting accuracy of the magnitude Vpp of the AC component Vac tends to decrease. That is, since these sensors are usually used for a halftone image, measurement in the second measurement range R2 is difficult even though measurement in the first measurement range R1 is possible. Therefore, it is preferable to use the developing current instead of the image density for setting the magnitude Vpp of the AC component Vac.

In addition, the approximation formulas are set to perform calculation in regions where the developing current tends to increase, tends to become stable, or tends to decrease; however, when the calculation is performed in a state where the change in the developing current is included in different regions due to some trouble, the setting of the magnitude Vpp of the AC component Vac will be incorrect. Therefore, in a case where the amount of deviation of the measurement data is large with respect to the approximation formula, it is necessary to exclude a part of the measurement data from the calculation as an error value. Therefore, when the approximation formula is calculated, the correlation coefficient is also calculated at the same time, and in a case where the correlation coefficient becomes a specified value (0.9 as an example) or less, when calculation is performed in the first measurement range R1, the measurement data having the highest Vpp is removed, and the approximation formula calculation is performed again. In a case of the second measurement range R2, there is a possibility of an abnormal current due to the occurrence of a leak, and thus approximation formula calculation is performed separately for the case where the measurement data when Vpp is the lowest is excluded, and the case where the measurement data when Vpp is the highest is excluded. The result with a high correlation coefficient that is equal to or greater than a specified value is used. Calculation in the second measurement range R2 is only performed in a case where the slope is less than a predetermined value. In a case where the correlation coefficient does not exceed the specified value even after the error value has been excluded, the error value is excluded again by the same method and recalculation is performed.

In addition, in the first measurement range R1 the developing current changes significantly, and thus it is preferable to set the first measurement range R1 as wide as possible. On the other hand, in the second measurement range R2 there is little change, and when Vpp is further increased, a development leak may occur. Further, in order to improve the measurement accuracy, it is desirable to increase the number of measurement points in a wide range; however, increasing the number of measurement points leads to an increase in toner consumption and an increase in measurement time. In consideration of this, it is preferable that the second measurement range R2 be narrower than the first measurement range R1 and that the number of measurement points be reduced.

[5.3] DC Calibration

As shown in FIG. 8, the DC setting processing portion 54 changes the value of the DC component Vdc of the developing bias VB to, for example, detected values V1, V2, V3, V4, and creates an image on the photoconductor drum 341. The DC setting processing portion 54 then acquires the density of the toner image at each detection value V1, V2, V3, V4 from the density detecting portion 365 as the sensor outputs Op1, Op2, Op3, Op4, respectively.

The DC setting processing portion 54 creates a first-order approximation formula in a graph in which the horizontal axis is the DC component Vdc and the vertical axis is the sensor output (output of the density detecting portion 365), and uses the approximation formula to find the voltage Vdc0 when the sensor output Op0 of the target image density is reached, and sets the magnitude of the DC component Vdc. However, in a case where the voltage Vdc0 obtained at this time is not equal to or less than the setting lower limit VdcL (40V as an example) of the DC component Vdc, or equal to or greater than the setting upper limit VdcH (200V as an example), the DC setting processing portion 54 sets the setting lower limit VdcL or the setting upper limit VdcH as the magnitude of the DC component Vdc.

[6] Modification

The plurality of components included in the image forming apparatus 10 may be dispersedly provided in a plurality of housings. For example, at least one of the AC setting processing portion 51, the potential measurement processing portion 52, and the drive processing portion 53 is not limited to the configuration achieved as one function of the control portion 5, and may be provided in a separate housing from the control portion 5.

In addition, in the first embodiment, it is presumed that the surface of the developing roller 343A has a "knurled groove+blast" structure, but the present invention is not limited to this. For example, the surface of the developing roller 343A may have a "knurled groove with slope+blast", "concave shape (dimple)+blast on the surface", "blast only", "knurled groove only" or "concave shape (dimple)".

Second Embodiment

Figure 9:
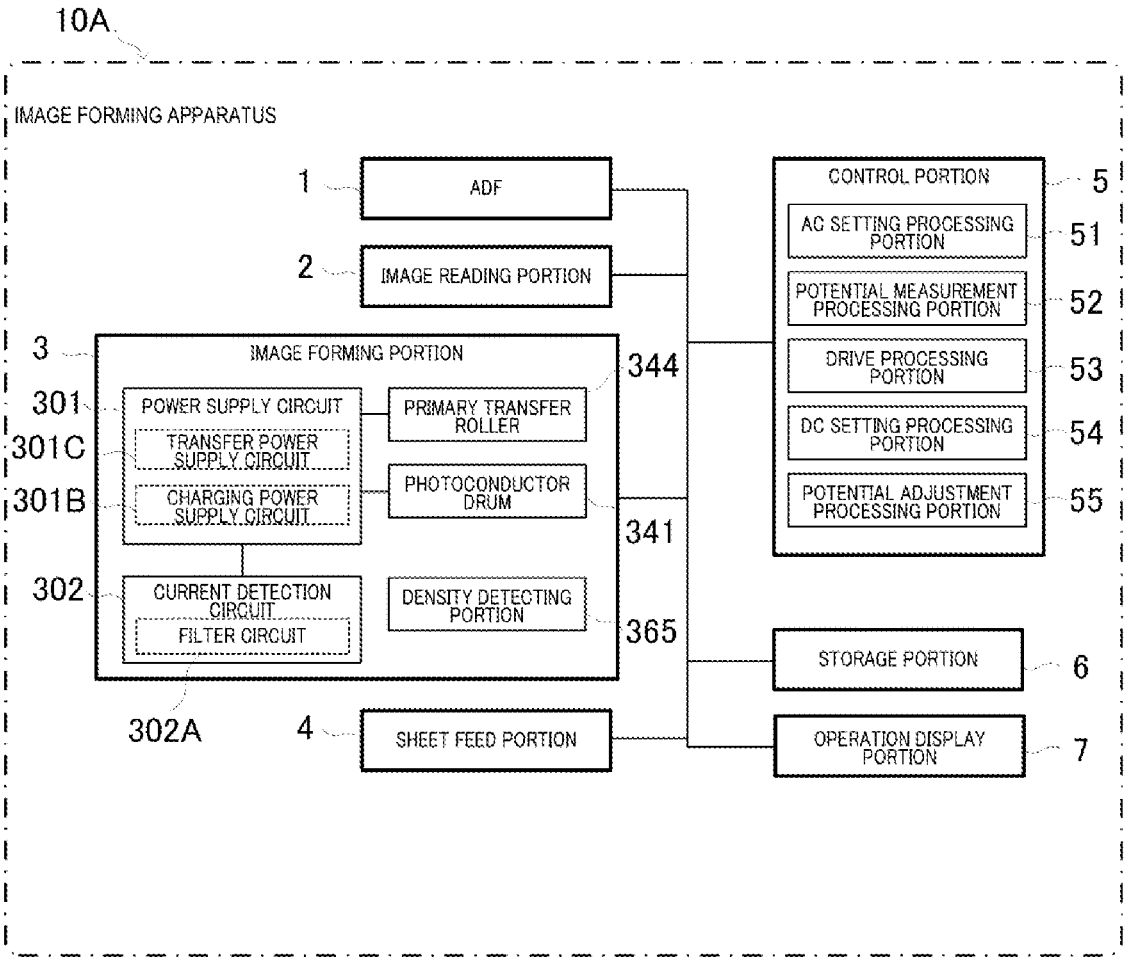
FIG. 9 is a block diagram showing a configuration of an image forming apparatus according to a second embodiment.

As shown in FIG. 9, an image forming apparatus 10A according to the present embodiment differs from the image forming apparatus 10 of the first embodiment in that the current detection circuit 302 detects current flowing between the primary transfer roller 344 and the photoconductor drum 341. Hereinafter, configurations that are the same as those in the first embodiment will be designated by common reference numerals and descriptions thereof will be omitted as appropriate.

In the present embodiment, the photoconductor drum 341 is an example of a "first carrying member", and the primary transfer roller 344 is an example of a "second carrying member". That is, the image forming portion 3 applies a high-voltage transfer bias between the photoconductor drum 341 and the primary transfer roller 344 in a transfer power supply circuit 301C of the power supply circuit 301. Thus, the image forming portion 3 moves toner having an electric charge from the photoconductor drum 341, which is the first carrying member, to the primary transfer roller 344, which is the second carrying member, by a transfer electric field, and forms a toner image (image) on the primary transfer roller 344 (second carrying member). That is, in a primary transfer process, the image forming portion 3 moves the toner having an electric charge from the first carrying member to the second carrying member to form an image on the second carrying member. The current detection circuit 302 outputs a detection signal corresponding to the magnitude of the transfer current flowing between the primary transfer roller 344 (second carrying member) and the photoconductor drum 341 (first carrying member) to the control portion 5.

In the present embodiment, the first carrying member is the photoconductor drum 341 and the second carrying member is the primary transfer roller 344, and thus a transfer bias is an example of the "bias voltage" and a transfer current is an example of the "target current". The potential measurement processing portion 52 measures (calculates) the surface potential Vs of the photoconductor drum 341, which is the first carrying member, of the first carrying member (photoconductor drum 341) and the second carrying member (primary transfer roller 344).

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus, comprising:

an image forming portion configured to apply a bias voltage in which an AC component is superimposed on a DC component between a first carrying member and a second carrying member, and to transfer toner from the first carrying member to the second carrying member to form an image on the second carrying member;

an AC setting processing portion configured to perform AC calibration to set a magnitude of the AC component of the bias voltage;

a potential measurement processing portion configured to measure a surface potential of the first carrying member or the second carrying member based on a target current flowing between the first carrying member and the second carrying member; and a drive processing portion configured to execute the AC calibration before measurement of the surface potential in a case where, when measuring the surface potential, an activation condition is satisfied.

2. The image forming apparatus according to claim 1, wherein the AC setting processing portion sets the magnitude of the AC component based on the target current.

3. The image forming apparatus according to claim 2, wherein the AC setting processing portion sets the AC component based on the target current when the magnitude of the AC component within a first measurement range is changed and the bias voltage is applied, and the target current when the magnitude of the AC component is changed within a second measurement range on the higher frequency side than the first measurement range and the bias voltage is applied.

4. The image forming apparatus according to claim 1, further comprising a DC setting processing portion configured to perform DC calibration for setting a magnitude of the DC component of the bias voltage, wherein the DC setting processing portion sets the magnitude of the DC component based on a density of a toner image.

5. The image forming apparatus according to claim 4, wherein the DC setting processing portion executes the DC calibration after measurement of the surface potential.

6. The image forming apparatus according to claim 5, wherein the DC setting processing portion, before executing the AC calibration, executes a pre-calibration for setting the magnitude of the DC component separately from the DC calibration.

7. The image forming apparatus according to claim 1, wherein the activation condition includes when measurement of the surface potential has been performed a specified number of times after the previous AC calibration.

8. The image forming apparatus according to claim 1, further comprising a potential adjustment processing portion configured to adjust the surface potential based on the surface potential measured by the potential measurement processing portion.

9. A control method of an image forming apparatus, the control method being used for an image forming apparatus comprising an image forming portion configured to apply a bias voltage in which an AC component is superimposed on a DC component between a first carrying member and a second carrying member, and to transfer toner from the first carrying member to the second carrying member to form an image on the second carrying member; the control method comprising:

performing an AC calibration to set a magnitude of the AC component of the bias voltage;

measuring a surface potential of the first carrying member or the second carrying member based on a target current flowing between the first carrying member and the second carrying member; and executing the AC calibration before measurement of the surface potential in a case where, when measuring the surface potential, an activation condition is satisfied.

* * * * *